US007540336B2

(12) United States Patent
Steffen

(10) Patent No.: US 7,540,336 B2
(45) Date of Patent: Jun. 2, 2009

(54) VIBRATION ISOLATOR FOR A PNEUMATIC POLE OR BACKFILL TAMPER

(75) Inventor: Kyle Steffen, Fredonia, WI (US)

(73) Assignee: M-B-W Inc., Slinger, WI (US)

( * ) Notice: Subject to any disclaimer, the term of this patent is extended or adjusted under 35 U.S.C. 154(b) by 27 days.

(21) Appl. No.: 11/439,755

(22) Filed: May 24, 2006

(65) Prior Publication Data

US 2006/0272837 A1 Dec. 7, 2006

Related U.S. Application Data

(60) Provisional application No. 60/686,639, filed on Jun. 2, 2005.

(51) Int. Cl.
*B23Q 5/00* (2006.01)

(52) U.S. Cl. ..... 173/162.1; 173/162.2; 173/170; 173/171; 173/210; 173/211

(58) Field of Classification Search ..... 173/162.1, 173/162.2, 170–171, 210–211; 404/133.05, 404/133.1

See application file for complete search history.

(56) References Cited

U.S. PATENT DOCUMENTS

| | | | | | |
|---|---|---|---|---|---|
| 665,391 | A | * | 1/1901 | Chapman | 267/137 |
| 1,481,641 | A | | 1/1924 | Jimerson | |
| 2,748,750 | A | * | 6/1956 | Altschuler | 173/162.1 |
| 2,875,731 | A | * | 3/1959 | Settles et al. | 267/137 |
| 3,277,801 | A | * | 10/1966 | Horvath et al. | 404/133.1 |
| 3,892,280 | A | * | 7/1975 | Klushin et al. | 173/162.1 |
| 3,939,923 | A | * | 2/1976 | Aldag et al. | 173/162.1 |
| 3,968,843 | A | | 7/1976 | Shotwell | |
| 4,044,625 | A | | 8/1977 | D'Haem et al. | |
| 4,303,002 | A | * | 12/1981 | Maslakov et al. | 91/225 |
| 4,402,369 | A | * | 9/1983 | Nikitin et al. | 173/18 |
| 5,050,689 | A | * | 9/1991 | Dobry et al. | 173/162.2 |
| 5,327,636 | A | * | 7/1994 | Wilson | 29/525 |
| 5,927,407 | A | | 7/1999 | Gwinn et al. | |
| 6,318,228 | B1 | * | 11/2001 | Thompson | 89/1.14 |
| 6,854,923 | B2 | * | 2/2005 | Greppmair | 404/133.1 |

FOREIGN PATENT DOCUMENTS

| | | | |
|---|---|---|---|
| DE | 3303531 | A1 | 9/1983 |
| GB | 816351 | A | 7/1959 |
| GB | 1432504 | A | 4/1976 |

* cited by examiner

*Primary Examiner*—Rinaldi I. Rada
*Assistant Examiner*—Michelle Lopez
(74) *Attorney, Agent, or Firm*—Andrus, Sceales, Starke & Sawall, LLP

(57) ABSTRACT

A vibration isolation assembly is provided for use with a backfill tamper. In use, the vibration isolation assembly can be disposed between a handle and a percussion mechanism of the tamper and absorbs kickback forces from the percussion mechanism during backfill tamper operation. In one embodiment, the assembly includes an elongated conduit member that defines a passageway that allows compressed air to pass through the member to the percussion mechanism and a vibration dampening piston arrangement for absorbing feedback forces from the percussion mechanism during backfill tamper operation. The assembly may further include a spring arrangement for dampening vibration emanating from the piston.

9 Claims, 5 Drawing Sheets

VIBRATION ISOLATOR FOR A PNEUMATIC POLE OR BACKFILL TAMPER

CROSS REFERENCE TO RELATED APPLICATION

The present application claims the benefit of co-pending U.S. Provisional Application Ser. No. 60/686,639, filed Jun. 2, 2005.

FIELD OF THE INVENTION

The present application relates to soil compaction, and more particularly relates to pneumatic pole or backfill tampers for compacting backfill.

BACKGROUND OF THE INVENTION

Municipalities, utility companies and similar organizations have historically used pneumatic pole or backfill tampers to compact soil in backfill areas. Backfill tampers are popular not only because they are lightweight and small, but also because can be easily and economically incorporated into existing outfits. For example, most municipalities have an air compressor that is used to operate other pneumatic tools. Backfill tampers therefore offer a low-cost alternative to other compaction devices such as for example gas-powered rammers.

Known pneumatic backfill tampers provide adequate compaction, but are difficult to operate for long periods of time because the tampers transmit a relatively large amount of feedback to the operator. Recently, there has been much attention paid to operator comfort while using small construction equipment. For example, the European Union has begun to limit the amount of time workers can operate vibratory equipment in hopes of reducing life-long problems including arthritis and nerve damage. These time limits are based on a frequency-weighted acceleration scale known as H.A.R.M.

It is therefore desirable to provide a backfill tamper with means to reduce the amount of feedback transmitted to the operator during use. It is further desirable to provide such a means for reducing feedback that is compact, economical, and adaptable for use with a wide variety of backfill tamper designs.

SUMMARY OF THE INVENTION

The present invention provides a means for reducing the amount of feedback transmitted to the operator during use of a backfill tamper. The invention is compact, economical and adaptable for use with a wide variety of backfill tamper designs.

In one arrangement, a vibration isolation assembly is designed to operate with a backfill tamper device. The vibration isolation assembly is disposed between the handle and the percussion mechanism of the tamper and arranged to absorb feedback forces from the percussion mechanism during tamper operation. The invention is intended for use with a variety of known tamper designs, and also can be incorporated into a newly-designed dedicated percussion assembly.

BRIEF DESCRIPTION OF THE DRAWINGS

The best mode of carrying out the present invention is described hereinbelow with reference to preferred embodiments depicted in the following drawing figures.

DETAILED DESCRIPTION OF THE PREFERRED EMBODIMENTS

In the preferred arrangements of the present invention described in detail below, a device for limiting vibration feedback from a pneumatic backfill pole or tamper is provided. It should be understood that the drawings and specification are to be considered merely an exemplification of the principles of the invention. For example, although the arrangements shown are provided for use with a specific tamper device, the present invention is applicable for use with a variety of known or newly designed tamper devices.

Figure 1:
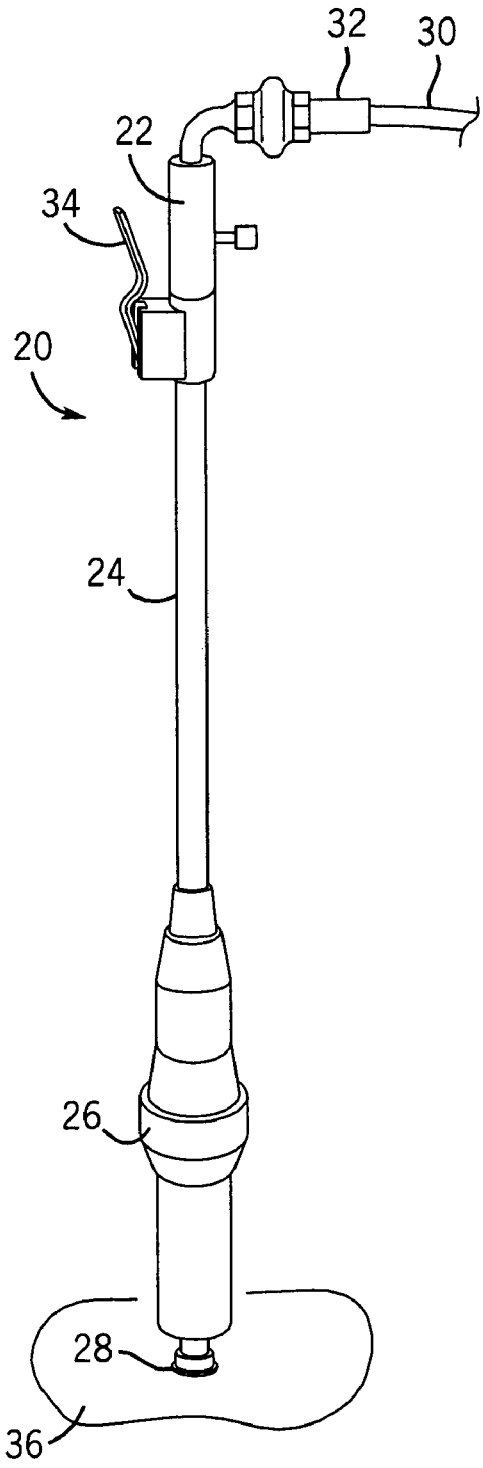
FIG. 1 PRIOR ART
FIG. 1 is a plan view of a prior art pneumatic tamper.

FIG. 1 depicts a known arrangement for a pneumatic backfill tamper that is commonly used in rental fleets and utility crews. The backfill tamper 20 includes an actuator handle 22, a center tube 24, a percussion mechanism 26 and a shoe 28. In use, an air hose 30 provides air from a compressor (not shown) to the top end of the tamper 20. More specifically, the air hose 30 connects to a fitting 32 on the top of the handle 22. A trigger 34 provided on the handle 22 is arranged to control the airflow from the hose 30 to the handle 22 and remaining components of the tamper 20.

Beneath the handle 22 is the center tube 24, which has a hollow interior and directs airflow from the handle 22 to the percussion mechanism 26. The center tube 24 also serves as an additional handle when the tamper 20 is manually operated.

The percussion mechanism 26 is beneath the center tube 24 and includes a series of valves that convert the airflow from the hose 30 into a cyclical percussion motion. The cyclical percussion motion is transmitted from the percussion mechanism 26 to the shoe 28 which in turn delivers impact force onto the ground 36. In a typical arrangement, the tamping shoe 28 is driven with a five-inch stroke at 500 BPM.

It is also known in the art to configure the tamper 20 for different depth jobs by changing the length of the center tube 24 between the actuator handle 22 and the percussion mechanism 26. Acceleration (vibration) of an air tamper is primarily in the vertical (axial) direction-coinciding with the action of the shoe 28. A vector sum (X, Y and Z) H.A.R.M. value of 25 to 35 is typical.

Figure 2:
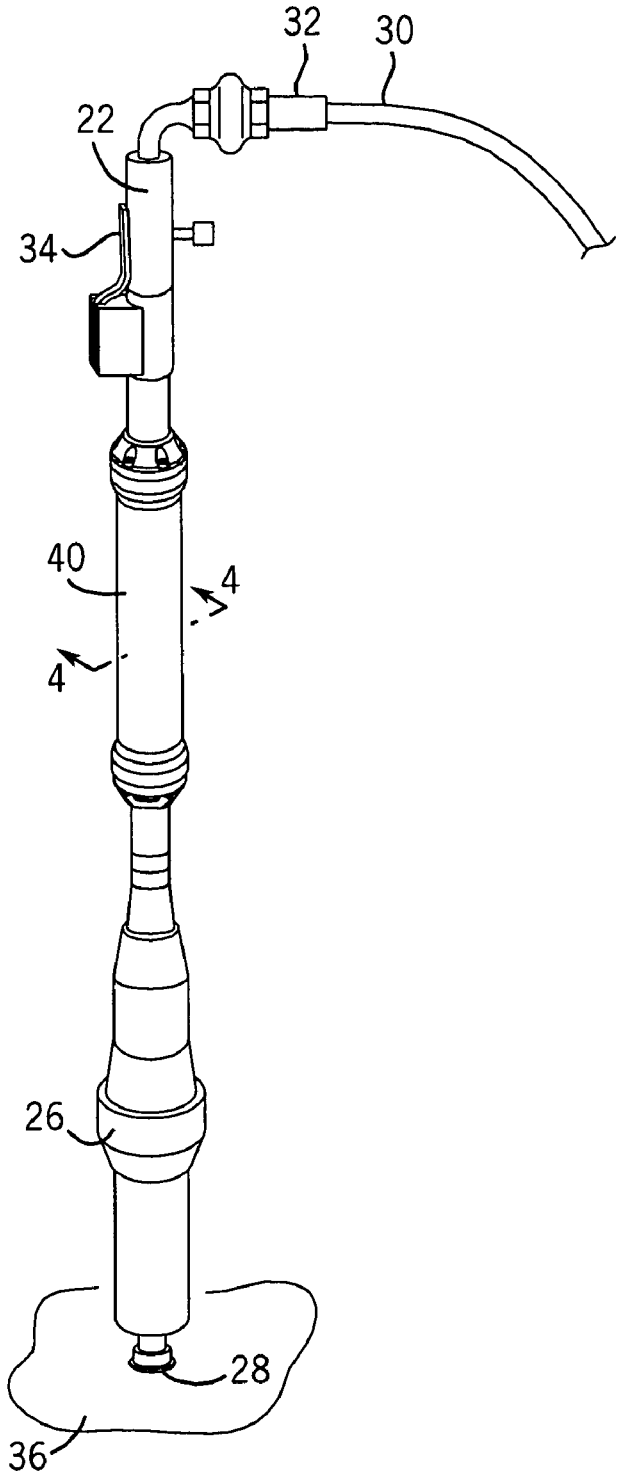
FIG. 2 is a plan view of a backfill tamper incorporating an isolator assembly of the present invention.

Referring to FIG. 2, a vibration isolator assembly 40 is provided in place of the center tube 24 on the prior art backfill tamper 20. The isolator assembly 40 is arranged to absorb the feedback or "kickback" from the percussion mechanism 26 and shoe 28 during operation. The isolator assembly 40 is shown assembled with the remaining components of the backfill tamper 20 depicted in FIG. 1. Known elements such as the actuator handle 22, percussion mechanism 26, shoe 28 and air hose 30 are referred to throughout the drawings with reference numbers corresponding to the prior art device shown in FIG. 1. It is also contemplated that instead of serving as a retrofit to existing tampers, the isolator assembly 40 could be integrated with a dedicated trigger and/or percussion assembly.

Figure 3:
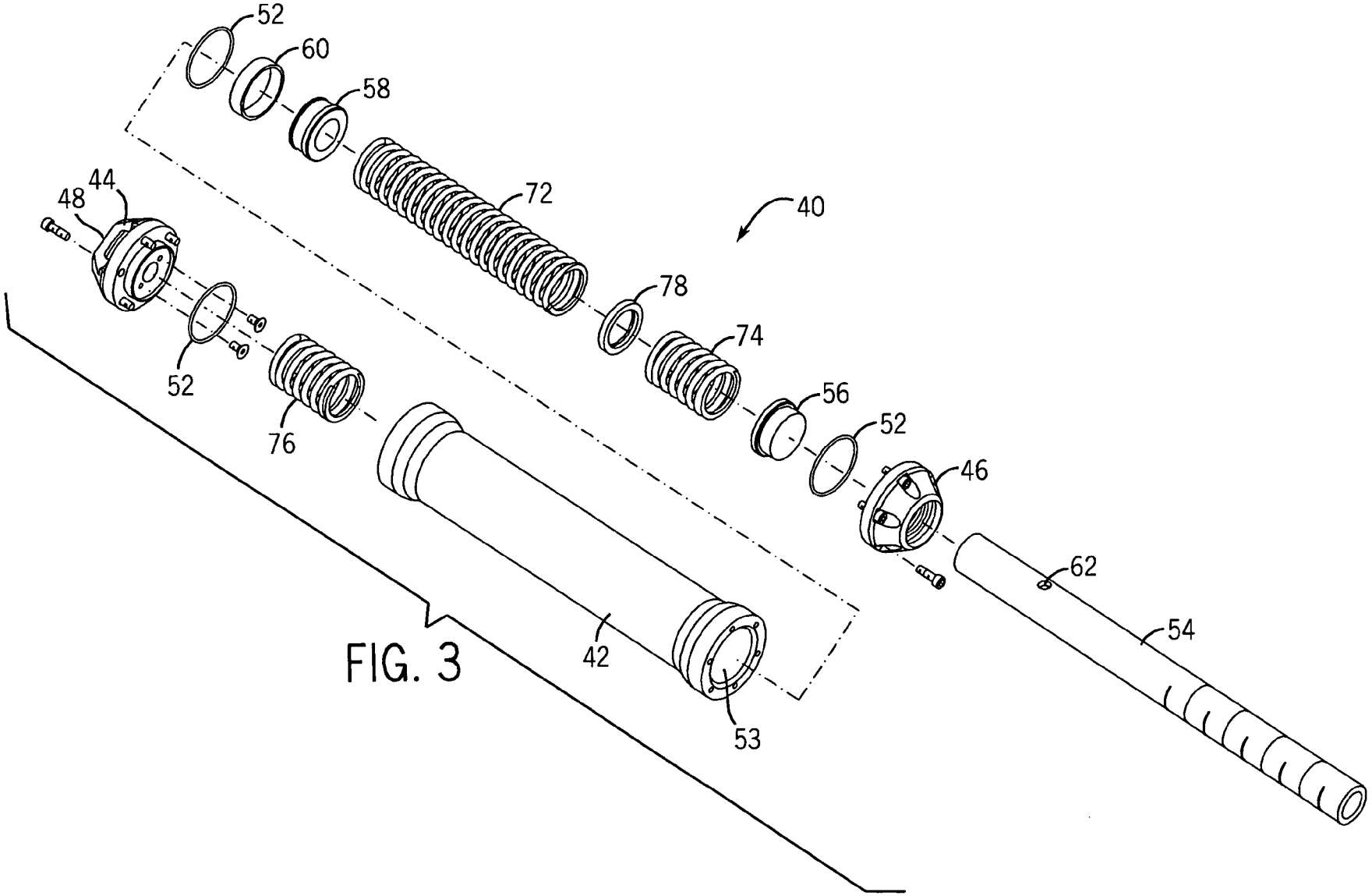
FIG. 3 is an exploded view of a vibration isolator assembly.
Figure 4:
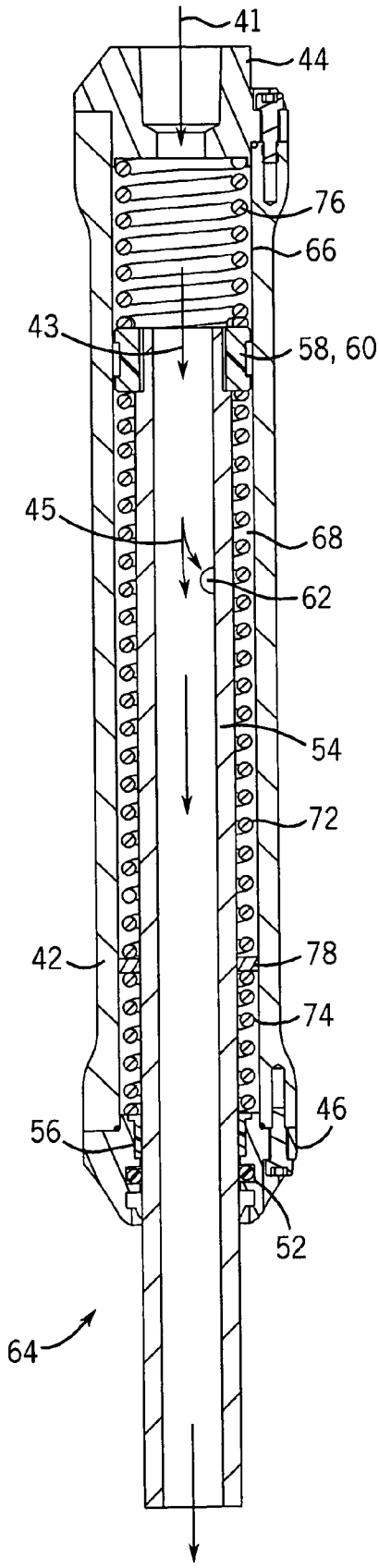
FIG. 4 is a cross-sectional view of the arrangement shown in FIG. 2.

Referring now to FIGS. 3 and 4, the isolator assembly 40 is shown in exploded and sectional views. The assembly 40 includes a conduit member or tube 42 fitted with opposing top and bottom end caps 44,46. Top end cap 44 includes a threaded adapter 48 for connection to most domestically produced backfill tampers, such as the device shown in FIG. 1. Seals 52 are provided adjacent the upper and lower end caps 44,46 to pneumatically seal the end caps 44,46 with the tube 42. It is also contemplated to provide different threaded adapters for connection to various other tamper designs. In addition, an extension pipe (not shown) could be added below the isolator assembly 40 if deep trench, utility pole, or other extended backfilling is required.

The tube 42 forms the main body of the isolator assembly 40 and is knurled to provide a hand grip for manual operation. The tube 42 defines a hollow channel 53 that allows compressed air to pass directly through the isolator assembly 40 to the percussion mechanism 26 without significant pressure drop. The channel 53 also houses a vibration dampening piston arrangement. More specifically, a plated piston rod 54 extends through a lower bushing 56 in the channel 53 and into an upper bushing 58 and puck 60. The rod 54 is hollow and includes an air hole 62, the purpose of which will be explained further below. The lower end 50 of rod 54 is threaded and designed to connect to the percussion mechanism 26. Together, the upper bushing 58, puck 60 and rod 54 constitute a piston 64 that axially reciprocates along the length of the channel 53. The bushing 58 and puck 60 divide the channel 53 into upper and lower chambers 66, 68, which change in respective length and volume as the piston 64 reciprocates (see FIG. 4). A seal 52 and wipers are provided along the bottom end cap 46 to seal the piston 64 with respect to the tube 42.

A plurality of springs are provided in the tube 42 to provide a dampening effect on vibrations emanating from the percussion mechanism 26. More specifically, a main spring 72 and a back-up spring 74 wrap around the piston rod between the opposed bushings 56,58. In addition, a second back-up spring 76 is provided adjacent the top cap 44. Preferably, the main spring 72 is longer and softer than the stiffer and shorter backup springs 74,76.

When the device is not in use, the springs 72,74,76 act upon each other and the piston arrangement to seek an equilibrium position. Springs 72 and 74 are separated by, and act upon opposite sides of a spacer 78. Springs 72 and 76 are separated by and act upon opposite sides of the bushing 58 and puck 60. Lower end of spring 74 acts upon flanged bushing 56 and upper end of spring 76 acts upon the upper end cap 44.

Once the trigger 34 of the backfill tamper device is activated, pressurized air from the air hose 30 enters the isolator assembly 40 as shown by arrow 41. The pressurized air fills the upper chamber 66, passes through the rod 54 towards the percussion mechanism 26 (arrow 43), passes out of the rod 54 through hole 62 (arrow 45), and enters the lower chamber 68. Due to the difference in projected area of the upper 66 and lower 68 chambers, air pressure causes the piston 64 to advance out of the tube 42 until equilibrium is reached with the force exerted by springs 72,74. This becomes the normal steady state operating position of the isolator assembly 40. The springs 72,74 and the force caused by the air pressure serve to isolate the motion of the piston 64 (created by the percussion unit 26) from the cylinder/top cap/trigger assembly.

The stiffness of the main spring 72 is determined by the range in expected operating pressures, the degree of isolation desired, and the percussion unit stroke. The stiffer backup spring 74 is designed to stop the piston 64 from bottoming out and making hard contact with the bottom end cap 46. It is contemplated that the springs 72,74 could alternately be replaced with a single variable rate spring. The backup spring 76 connected to the top cap 44 prevents a hard contact between the piston 64 and the top cap 44. Both backup springs 74,76 will normally only be compressed during starting/stopping and other operating transients.

The isolator assembly 40 may include polymer bearings 56,60 which allow it to run without lubrication if necessary. The bearings are specified to provide a long service life. Additionally, all components can be plated to prevent corrosion from condensation in the air supply. A second function of the seals is to protect the springs, bushings, and channel from dirt and other debris. Also, the air moving through the assembly 40 advantageously acts as a coolant to increase operator comfort and increase bearing and seal life.

The arrangement shown and described above has been found to reduce vibration transferred to the operator by up to 70% when compared to prior art tampers such as the tamper 20 shown in FIG. 1. This vibration reduction will decrease the likelihood of machine operators developing serious and lifelong musculoskeletal injuries.

Figure 5:
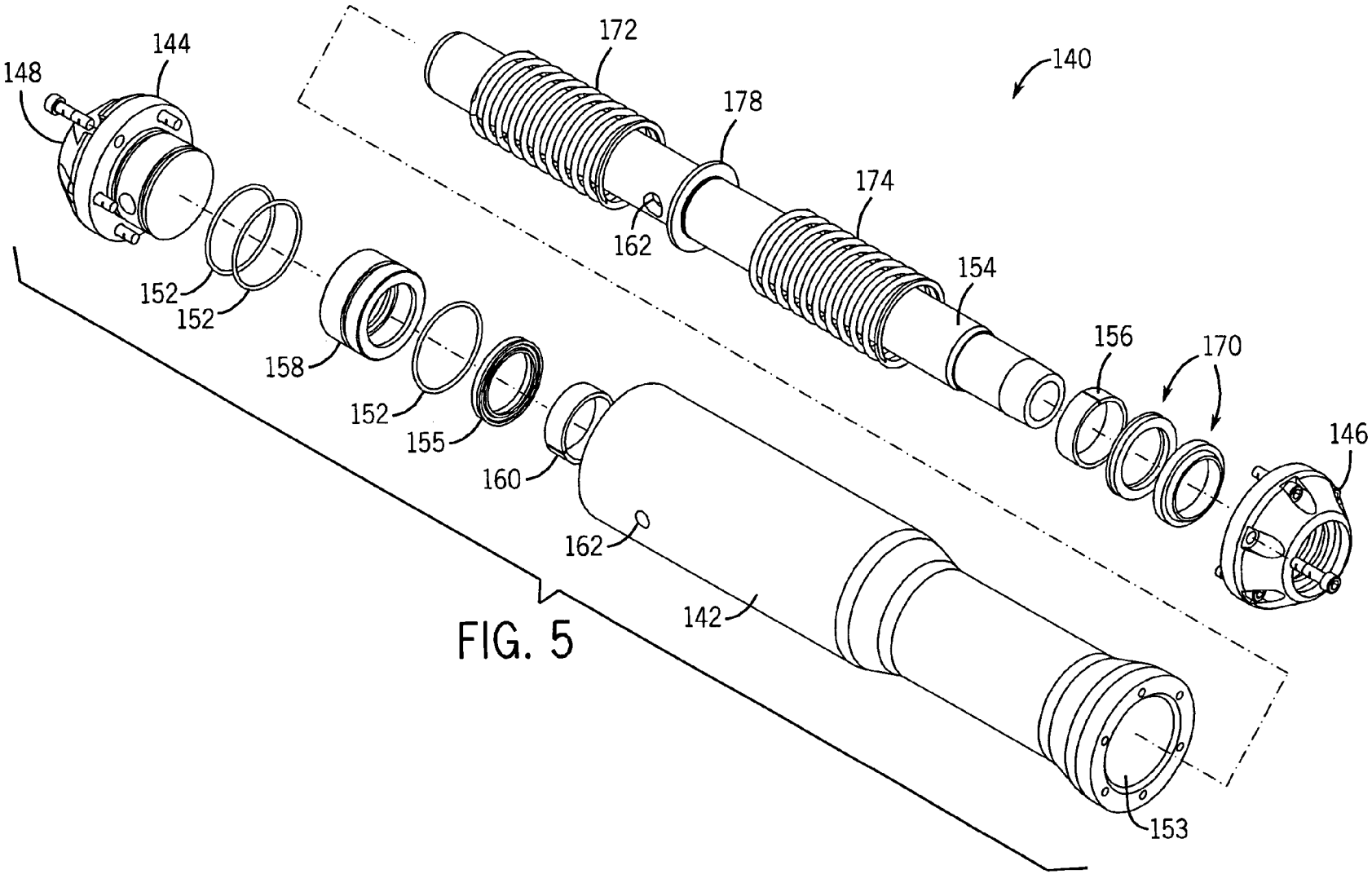
FIG. 5 is an exploded view of another vibration isolator assembly.
Figure 6:
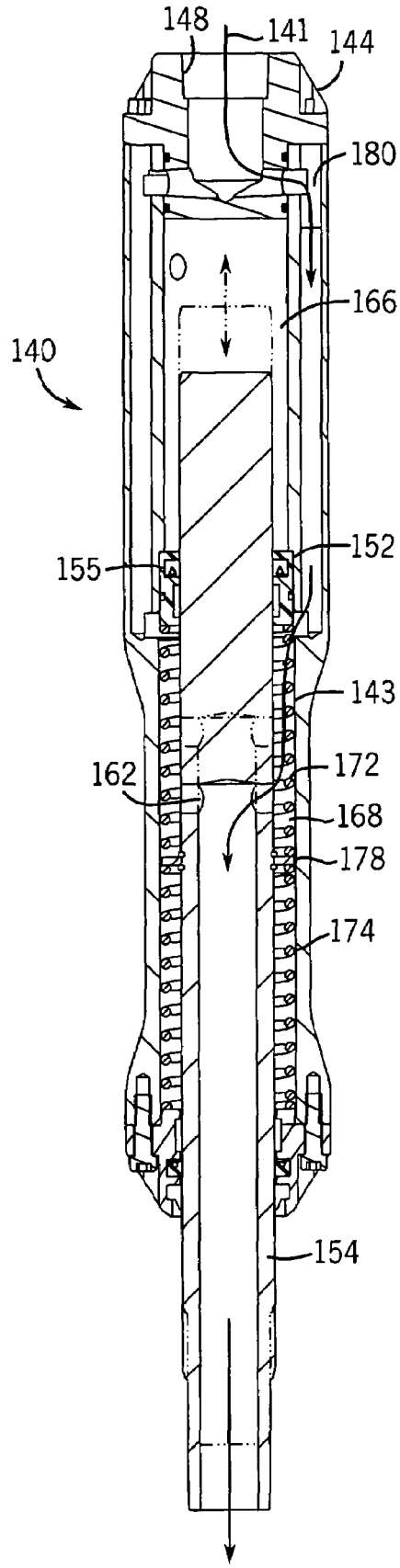
FIG. 6 is a cross-sectional view of the arrangement shown in FIG. 5.

FIGS. 5 and 6 depict an alternate arrangement of the isolator assembly 140 in exploded and sectional views, respectively. The assembly 140 includes a conduit member or tube 142 fitted with opposing top and bottom end caps 144,146. Top end cap 144 includes a threaded adapter 148 for connection to most backfill tampers, such as the device shown in FIG. 1. Seals 152 are provided adjacent the upper end cap 144 to pneumatically seal the end cap 144 with the tube 142. A seal and wiper arrangement 170 is provided adjacent the lower end cap 146 to pneumatically seal the end cap 146 with the tube 142. It is also contemplated to provide different threaded adapters for connection to various other tamper designs. In addition, an extension pipe (not shown) could be added below the isolator assembly 140 if deep trench, utility pole, or other extended backfilling is required.

The tube 142 forms the main body of the isolator assembly 140 and is knurled to provide a hand grip for manual operation. The tube 142 defines a hollow channel 153 that allows compressed air to pass directly through the isolator assembly 140 to the percussion mechanism 26 without significant pressure drop. The channel 153 also contains a vibration dampening piston arrangement. More specifically, a plated piston rod 154 extends into, and reciprocates in the channel 153. The upper end of the piston rod extends through a seal arrangement 152,155 enclosed in a puck 158. The lower end of the piston rod 154 extends through a bearing 156 and the aforementioned seal and wiper arrangement 170, and ultimately through the bottom end cap 146. The lower end of rod 154 is threaded and designed to connect to the percussion mechanism.

The seal arrangement 152,155 and puck 158 reside in the channel 153 in a static position so as to divide the channel 153 into upper 166 and lower 168 chambers (see FIG. 6).

Opposing springs are provided on the piston rod 154 to provide a dampening effect on vibration emanating from the percussion mechanism 26. More specifically, an upper spring 172 and a lower spring 174 wrap around the piston rod 154 opposite a washer 178. The piston rod 154 further includes an aperture 162 for receiving pressurized air from the air compressor, as will be discussed further in detail below. When the device is not in use, the springs 172,174 act upon each other and the piston arrangement seeks an equilibrium position.

Referring to FIG. 6, once the trigger 34 of the backfill tamper device is activated, pressurized air from the air hose 30 enters the isolator assembly 140. The pressurized air enters the upper end cap 144 (arrow 141) and flows through a passageway 180 along the upper chamber 166. The air exits the passageway 180 after it passes by the seal arrangement 152, 155 and enters the lower chamber 168, as shown by arrow 143. The air then flows through the aperture 162 in the piston rod 154 and out of the piston rod 154, ultimately to the compression device 26.

The seal arrangement 152,155 ensures that the upper chamber 166 remains separated from the pressurized air and at a constant pressure, preferably atmospheric pressure. When the tamper 20 is operated, pneumatic forces are balanced and no "net movement" of the piston rod 154 occurs as a result of the pressure from the pressurized air. The spring rate can thus be decreased in comparison to the arrangement shown in FIGS. 3 and 4 to improve the isolating capability and potentially shorten the assembly 140.

It is recognized that other alternatives and equivalents not mentioned, described or depicted in the attached drawings remain within the scope of the present application.

What is claimed is:

1. A backfill tamper comprising:

a handle having a lower end;

an elongated conduit member having a lower end and an upper end that is coupled to the lower end of the handle;

a piston disposed in the conduit member;

a rod coupled to the piston and having a lower end that extends out of the lower end of the conduit member, wherein the piston and rod are configured to reciprocate up and down together in the conduit member;

a spring disposed in the conduit member between the piston and the lower end of the conduit member, the spring configured to bias the piston away from the lower end of the conduit member; and a percussion generating mechanism having an upper end coupled to the lower end of the rod, wherein the percussion generating mechanism is configured to receive a supply of pressurized air and convert the supply of pressurized air into a reciprocating percussive force; and a supply of pressurized air configured to flow through the conduit member to the percussion generating mechanism, wherein the supply of pressurized air biases on the piston against the bias of the spring;

wherein feedback from the reciprocating percussive force of the percussion generating mechanism causes the rod and piston to reciprocate up and down in the conduit member such that the direction of the feedback and the reciprocations of the rod and piston remain in phase with each other; and wherein the reciprocating movements of the rod and piston are dampened by the counteracting forces of the spring and the supply of pressurized air to thereby limit transfer of feedback from the percussion generating mechanism to the handle.

2. The backfill tamper of claim 1, wherein the piston seals with the interior of the conduit member and divides the interior of the conduit member into upper and lower chambers that change in size as the piston and rod reciprocate up and down in the conduit member.

3. The backfill tamper of claim 1, wherein the supply of pressurized air flows through the rod to the percussion generating mechanism.

4. The backfill tamper of claim 3, wherein the rod comprises an aperture through which the pressurized air passes via the rod from the conduit member to the rod.

5. The backfill tamper of claim 4, wherein the rod comprises an aperture through which the pressurized air passes from the conduit member to the percussion generating mechanism.

6. The backfill tamper of claim 1, wherein when the percussion generating mechanism is not operating, the pressurized air causes the rod to advance out of the lower end of the conduit member until an equilibrium state is reached between the pressurized air acting on the piston and the spring acting on the piston.

7. The backfill tamper of claim 1, comprising a spring disposed between the upper end of the conduit member and the piston and configured to prevent the piston from engaging the upper end of the conduit member during reciprocations.

8. The backfill tamper of claim 1, comprising a second spring disposed between the lower end of the conduit member and the piston, the second spring configured to prevent the piston from engaging with the lower end of the conduit member during reciprocations.

9. The backfill tamper of claim 1, comprising a shoe coupled to the lower end of the percussion generating mechanism, the shoe configured to engage a tamping surface and transfer percussive force from the percussion generating mechanism to a tamping surface.

* * * * *